US007438213B2

(12) United States Patent
Ackley et al.

(10) Patent No.: US 7,438,213 B2
(45) Date of Patent: Oct. 21, 2008

(54) VOTING BALLOT ENVELOPE

(75) Inventors: Jay C. Ackley, Mercer Island, WA (US); David W. Haines, Marysville, WA (US); Vernon R. Haines, Marysville, WA (US)

(73) Assignee: K & H Printers-Lithographers, Inc., Everett, WA (US)

( * ) Notice: Subject to any disclaimer, the term of this patent is extended or adjusted under 35 U.S.C. 154(b) by 690 days.

(21) Appl. No.: 10/910,824

(22) Filed: Aug. 3, 2004

(65) Prior Publication Data

US 2005/0061866 A1 Mar. 24, 2005

Related U.S. Application Data

(60) Provisional application No. 60/497,033, filed on Aug. 22, 2003.

(51) Int. Cl.
*B65D 27/06* (2006.01)

(52) U.S. Cl. ..... 229/301; 229/300; 229/305; 229/306

(58) Field of Classification Search ..... 229/80, 229/300, 301, 305, 306; 235/386; 283/5
See application file for complete search history.

(56) References Cited

U.S. PATENT DOCUMENTS 1,045,836 A 12/1912 Guina
1,164,606 A 12/1915 Wittmann
1,371,670 A 3/1921 Dority et al.
1,401,324 A 12/1921 Dority et al.
1,575,769 A 3/1926 Kaye
1,952,972 A 3/1934 Councilor
2,062,776 A * 12/1936 Berkowitz ..... 229/80
2,931,559 A 4/1960 Hilliard
3,802,618 A 4/1974 Wiessner
3,908,892 A * 9/1975 Pelzer ..... 229/305
4,288,028 A * 9/1981 Diaz ..... 229/302
4,565,317 A * 1/1986 Kranz ..... 229/302
4,602,736 A 7/1986 Barr
4,688,715 A 8/1987 Barr
5,271,553 A * 12/1993 Kim ..... 229/303
5,516,040 A 5/1996 Lin
6,409,079 B1 * 6/2002 Hutchinson ..... 229/305
6,499,652 B1 * 12/2002 Flynn et al. ..... 229/71

* cited by examiner

*Primary Examiner*—Nathan J Newhouse
*Assistant Examiner*—Jack H Morgan, Jr.
(74) *Attorney, Agent, or Firm*—Christensen O'Connor Johnson Kindness PLLC

(57) ABSTRACT

A return envelope for a ballot on which the voter's address is printed has a folding flap configured so as to eliminate the possibility that the return envelope with an enclosed ballot will be returned to the voter's address and assures that it will be returned to the organization of service providing or conducting the election. The envelope flap also is folded so as to provide verification information from the voter while maintaining the contents of the envelope secret.

12 Claims, 9 Drawing Sheets

VOTING BALLOT ENVELOPE

CROSS-REFERENCE TO RELATED APPLICATION

This application claims the benefit of U.S. Provisional Application No. 60/497,033, filed Aug. 22, 2003. Priority under 35 U.S.C. § 119(e) is hereby claimed based on the provisional application.

FIELD OF THE INVENTION

This invention relates to preprinted return mailing envelopes, and more particularly, to envelopes used for returning mail-in or absentee ballots, which envelopes contain unique information identifying a particular voter.

BACKGROUND OF THE INVENTION

A significant number of ballots in various types of elections are cast via the mail. Ordinarily, the ballots and a return envelope are sent out in an original master envelope to the voter. The voter then marks the ballot, places it in the return envelope, and places the return envelope in the mail. The return envelope typically carries the address for the voter on the backside of the envelope. The original envelope has a see-through address window in it. The voter's address is located on the return envelope so that when it is mailed in the original envelope, the voter's address is visible through the window. The return address is printed on the front side of the return envelope, along with either an indication to place a stamp in the upper right-hand corner or that the postage is prepaid.

Although the postal service regulations call for the envelope to be delivered to the address on the side with the postage, it is still possible through human error for the envelope to be mailed or returned to the voter's address on the reverse side of the envelope. Many schemes have been attempted to eliminate this from happening, but it still occurs on occasion even though there is a notice on the reverse side of the return envelope that the mail service is not to deliver to the voter's address. If, of course, the envelope is returned to the incorrect address, that ballot may be postmarked and/or delivered too late for the particular election.

Some organizations and/or jurisdictions require a validation signature and/or affidavit. In the past, separate envelopes have been required for the signature and/or affidavit. It is desirable to eliminate the extra envelope and incorporate the validation signature and/or affidavit into the envelope carrying the voter's address and voter information.

SUMMARY OF THE INVENTION

The present invention therefore provides a return envelope for a ballot on which the voter's address is printed, eliminates the possibility that the return envelope with an enclosed ballot will be returned to the voter's address, and assures that it will be returned to the organization or service provider conducting the election. In a preferred embodiment, the envelope has a front flap and rear flap joined to form a pocket at the upper end thereof. A third flap is joined to the upper edge of the front flap along a first zone of weakness. The third flap is foldable along the first zone of weakness in a rearward and downward direction to a first position located behind the rear flap. The third flap in the first position has an upper portion joined to the front flap along the first zone of weakness and a second portion joined to the first portion along a second zone of weakness.

The first portion has first address information printed thereon and is visible when the third flap is in the first position. The first portion has identifying indicia thereon corresponding to the first address visible when the third flap is in the first position. The third flap is further foldable upwardly to a second position above the front flap. The lower portion is foldable rearwardly and downwardly when the third flap is in the second position to a third position behind the first portion. The first and second portions are then foldable downwardly and rearwardly from the third position to a fourth position behind the second flap to close the pocket. At least one of the second portion and the rear flap has an adhesive thereon for adhering the second portion to the rear flap to seal the envelope.

In another important embodiment of the invention, a voter affidavit, signature and/or instructional information is printed on the backside of at least one of the intermediate or outer portions of the third flap. In this embodiment, the upper edge of the rear flap is positioned below the upper edge of the front flap so as to expose an upper portion of the rear surface of the front flap. Adhesive is applied to the outer surface of the outer portion of the third flap so that when folded to the fourth position, the outer portion is sealed to both the upper portion of the front flap and to the rear flap. The intermediate portion of the third flap can then be separated from the envelope to reveal the information on the inside of the third flap without unsealing the envelope. This allows, for example, for signature verification of the voter before freeing a ballot from the envelope.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Figure 1:
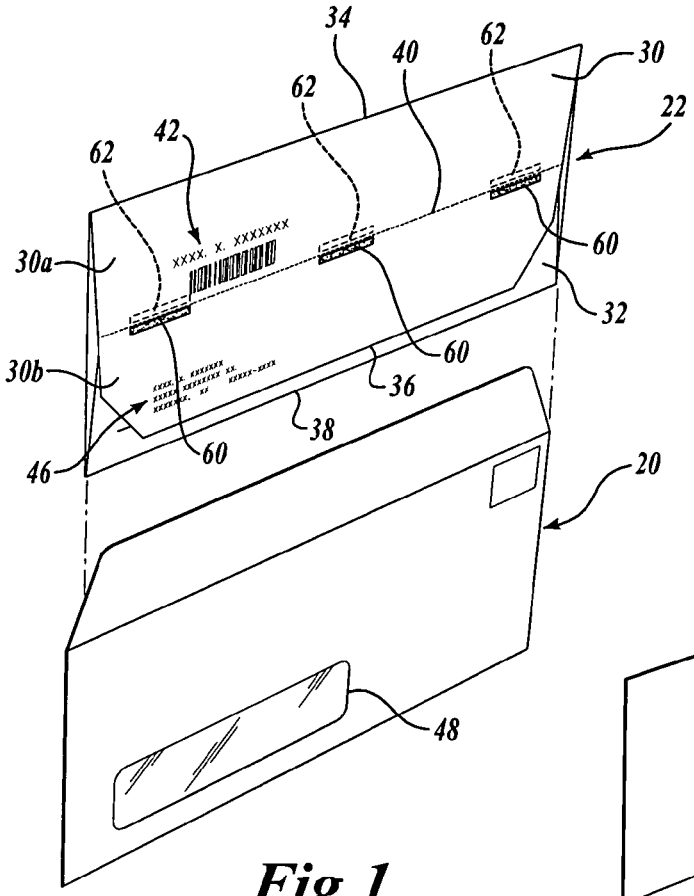
FIG. 1 is an exploded isometric view of an original envelope and a return envelope constructed in accordance with the present invention.
Figure 1A:
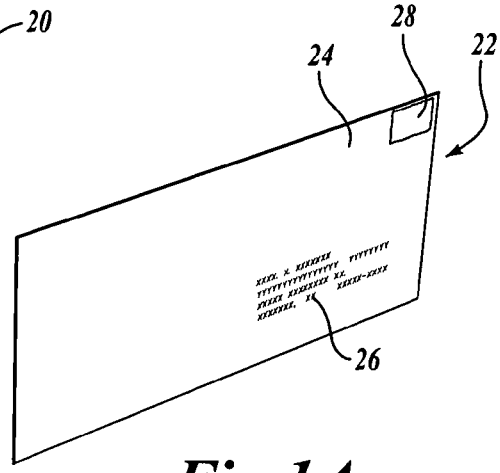
FIG. 1A is an isometric view of the front side of the return envelope.

Referring to FIGS. 1 and 1A, an original mailing envelope 20 and a ballot return envelope 22 are shown positioned so that the return envelope 22 can be inserted in the original mailing envelope 20. When the voter receives the original envelope 20, it contains the return envelope 22 and an appropriate ballot (not shown). The front side 24 of the return envelope 22 contains the address 26 of the organization conducting the balloting to which the envelope 22 is to be returned. This organization could be a municipality, county, state, or an organization, such as a union or bar association. The front side 24 of the return envelope has a location 28 for affixing postage. Alternatively, a notice that the postage is prepaid can be printed on the envelope at this location 28.

The return envelope 22 carries a flap 30, which is shown folded downwardly toward the backside 32 of the return envelope 22. The flap 30 folds along a zone of weakness 34, in this embodiment a score line located coincident with the upper edge of the return envelope 22. Preferably, the flap 30 has its outer edge 36 positioned slightly above, but adjacent the lower edge 38 of the return envelope. The flap 30 may also have side edges that are tapered downwardly and inwardly toward the outer edge 36. The flap 30 is divided into two portions, an intermediate portion 30*a* and an outer portion 30*b*, in the preferred embodiment roughly in half, by a horizontal zone of weakness 40 extending horizontally across the central portion of the flap 30. Preferably, the zone of weakness 40 is substantially parallel to the zone of weakness 34 at the upper edge of the envelope 22.

On each return envelope, unique information is printed relating to the voter to whom the ballot is being sent. In the preferred embodiment, this information is printed on the outside of the flap 30. Certain of this information 42 is printed on the intermediate portion 30*a* of the flap 30. This information 42 can contain, for example, a human readable form of the voter's unique information, for example, the voter's name and a bar code readable form of the voter's name and perhaps address. A human readable form of the voter's address 46 is positioned preferably on the outer portion 30*b* of the flap 30. This information 46 is positioned on the flap 30 so that it is viewable through a transparent window 48 in the original mailing envelope 20 when the return envelope 22 is inserted into the original envelope 20. The flap 30 also carries one or more bands of adhesive 60. These bands of adhesive 60 are positioned immediately below the zone of weakness 40. The adhesive can be of the conventional wettable type or any of a variety of other adhesives, such as contact adhesives that adhere directly to paper or to juxtaposed bands of the same kind of adhesive.

Figure 2:
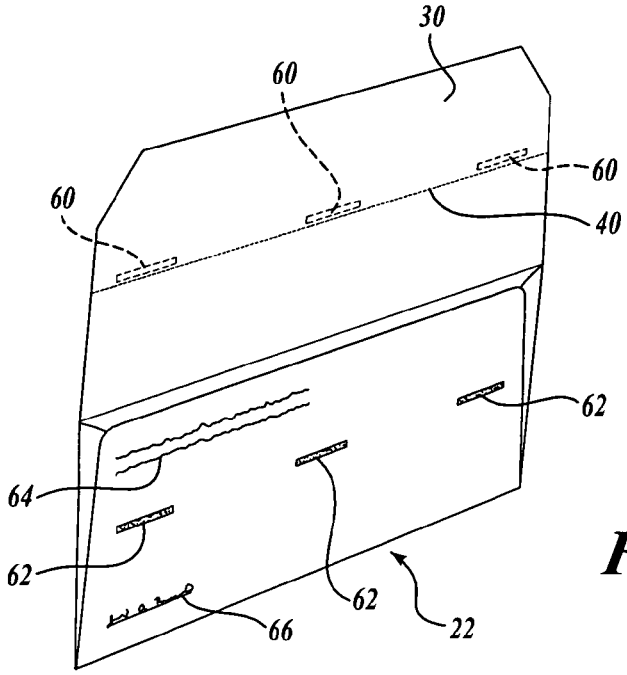
FIG. 2 is an isometric view of the reverse or backside of the return envelope showing the flap in an open position.

Referring to FIG. 2, the flap 30 of the return envelope 22 is shown folded in an upward direction so that a ballot can be inserted in the pocket of the return envelope 22. In this embodiment, a second set of adhesive bands 62 are positioned on the backside of the envelope at a location immediately above the zone of weakness 40 on the flap 30 when it is folded in a downward position. The second bands of adhesive 62 are shown in ghost outline in FIG. 1.

Figure 3:
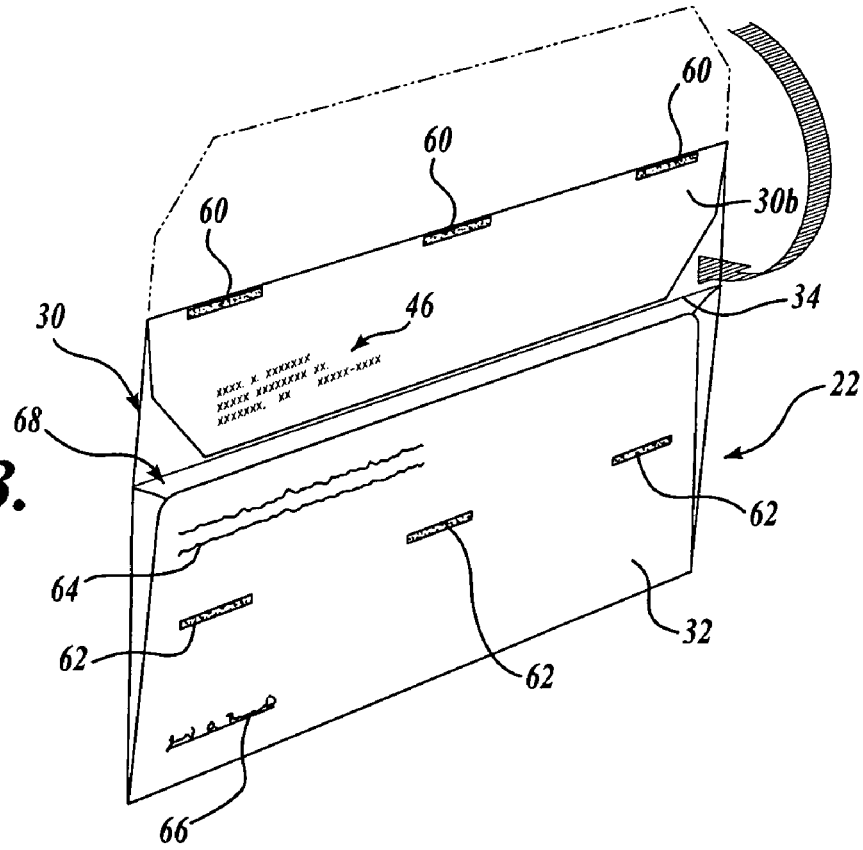
FIGS. 3 and 4 are isometric views showing the flap of the return envelope being folded in accordance with the present invention to obscure the voter's address.

When the voter has completed his or her ballot, the ballot is inserted in the pocket 68 of the envelope 22 and the flap is folded as shown in FIG. 3. In some instances the ballot may be placed in a secrecy envelope (not shown) and the secrecy envelope inserted in the pocket 68. After the ballot is inserted, the outer portion 30*b* of the flap 30 is folded downwardly and inwardly toward the intermediate portion 30*a* of the flap. This causes the bands of adhesive 60 on the outer portion 30*b* of the flap 30 to be positioned on what is now effectively the inside of the flap. Also, because the original mailing address 46 of the voter was positioned on the outer portion 30*b* of the flap, it now resides on the inside of the intermediate portion 30*a* of the flap 30. When the bi-folded flap 30 is then folded downwardly along the original fold line 34 toward the backside 32 of the envelope, the bands of adhesive 60 on the lower half of the flap will mate with the second bands of adhesive 62 on the backside of the envelope. Because these adhesives are preferably of the type that adhere to each other when they come in contact, the envelope will then be sealed. Again, a variety of adhesives and adhesive types can be used. For example, if a wettable adhesive is used, it would preferably be positioned only in the location of the bands of adhesive 60 so that they can be easily moistened by the user before the bi-folded flap 30 is folded back on the backside 32 of the envelope 22.

Figure 4:
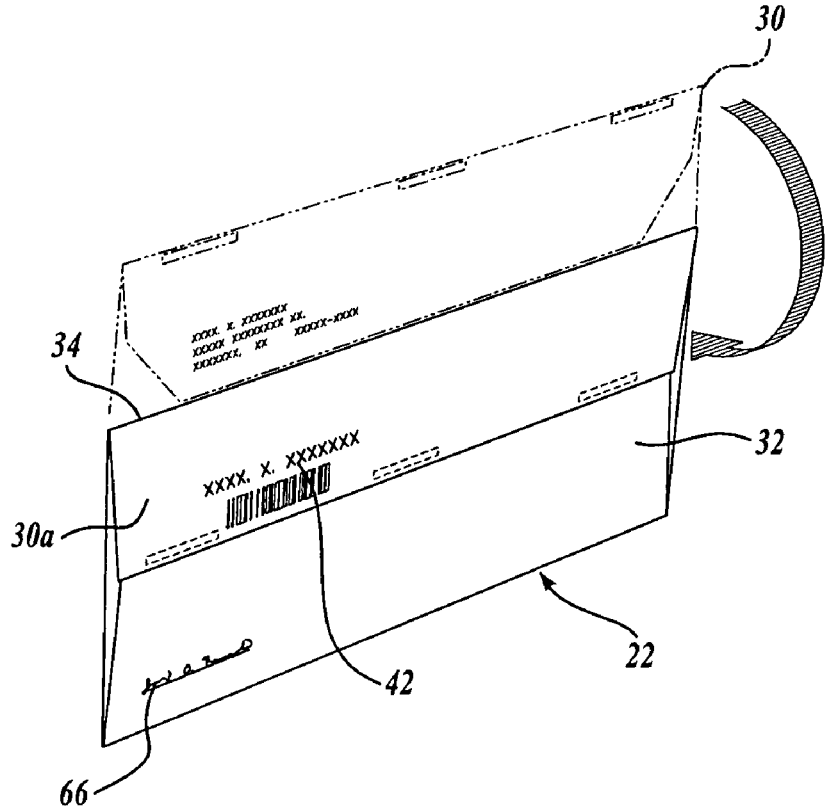

In FIG. 4, the return envelope 22 is shown in a sealed position. It will be noted that the human readable and machine readable voter information 42 is still readable on the intermediate portion 30*a* of the flap 30, but that the original mailing address of the voter is now obscured under the intermediate portion 30*a* of the flap 30. Thus, the original mailing address is not visible to be confused with the return address on the front side of the return envelope 22.

Also, as shown in FIGS. 2, 3, and 4, the return envelope can contain further instructions 64 to the voter and a signature line 66. In the embodiment shown in FIGS. 1-4, the instructions 64 are printed on the upper half of the backside of the return envelope, while the signature line for the voter is positioned on the lower half of the backside of the envelope. Thus, when the envelope is folded and sealed as shown in FIG. 4, the signature 66 is readily visible for validation purposes without further manipulation of the envelope.

Figure 5:
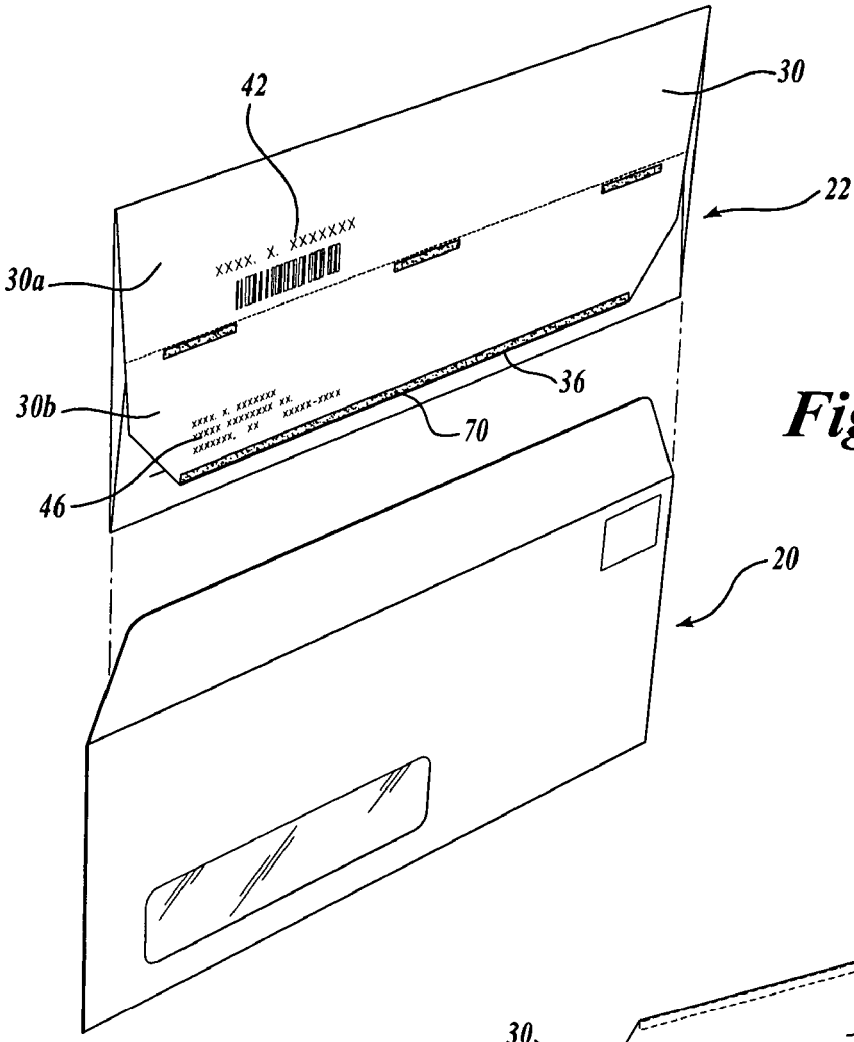
FIGS. 5, 6, 7, 8A, and 8B are isometric views of a second embodiment of the present invention.
Figure 6:
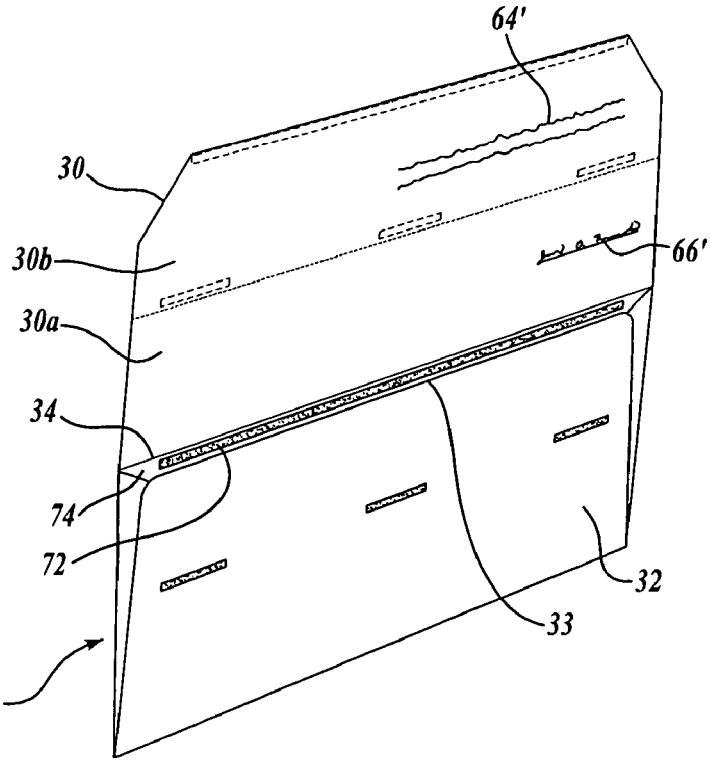

However, some election laws require or the organization conducting the election prefers that the signature of the voter be obscured from the ordinary observer as the return envelope is mailed through the mail to the balloting organization. Referring to FIGS. 5-8, a second embodiment of the invention is illustrated that allows the instructions/voter affidavit 64' and signature 66' of the voter to be hidden from ordinary view. As shown in FIG. 5, the return envelope 22 contains the same printed indicia 42 on the intermediate portion 30*a* of the flap 30 and the same original address 46 on the outer portion 30*b* of the flap 30. The original mailing address and the original envelope 20 remain the same as in the previous embodiment. In this embodiment, however, a third band or bands of adhesive 70 are positioned adjacent the outer edge 36 of the flap 30. As shown in FIG. 6, a mating band or bands of adhesive 72 are positioned on the backside 74 of the front panel of the return envelope just below the fold or score line 34. The envelope itself is designed so that the upper edge 33 of the backside 32 of the envelope resides a small distance below the zone of weakness 34.

Figure 7:
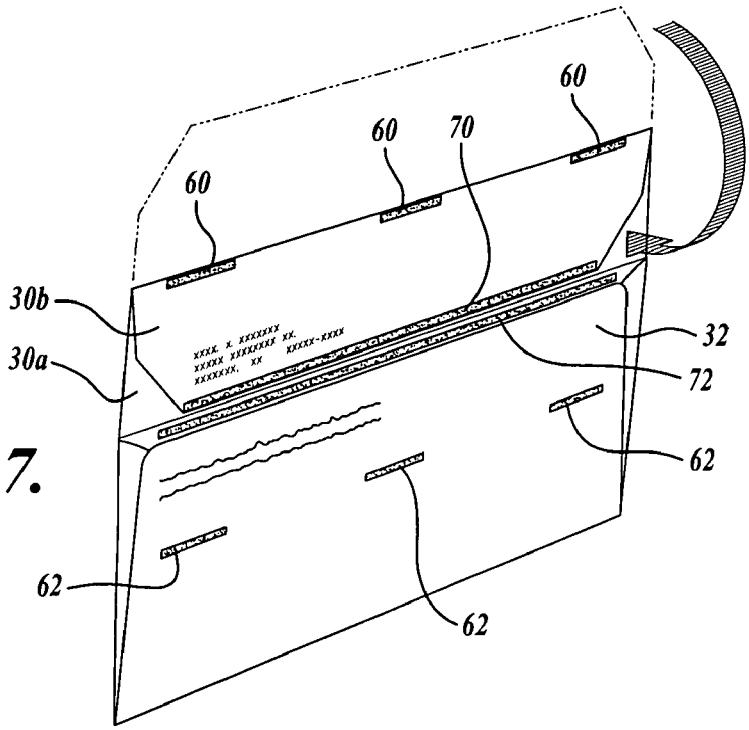

In this embodiment, the instructions to and/or affidavit of the voter 64' and the voter signature line 66' are printed on the backside of the flap 30. In this embodiment, the voter instructions/affidavit 64' are printed on the backside of the outer portion 30*b* and the signature line 66' is printed on the backside of the intermediate portion 30*a*. When the outer portion 30*b* of the flap is folded inwardly toward the inner side of the intermediate portion 30*a* as shown in FIG. 7 (similarly to the previous embodiment), the zones of adhesive 60 on the outer portion 30*b* now appear on what is effectively the backside of the flap 30. Similarly, the band or bands of adhesive 70 adjacent the lower edge of the outer portion 30*b* also appear on what is now effectively the backside of the flap 30. When the bi-folded flap is then folded down toward the backside 32 of the return envelope 22, the bands of adhesive 60 mate with the bands of adhesive 62, and similarly, the bands of adhesive 70 mate with the bands of adhesive 72.

Figure 8A:
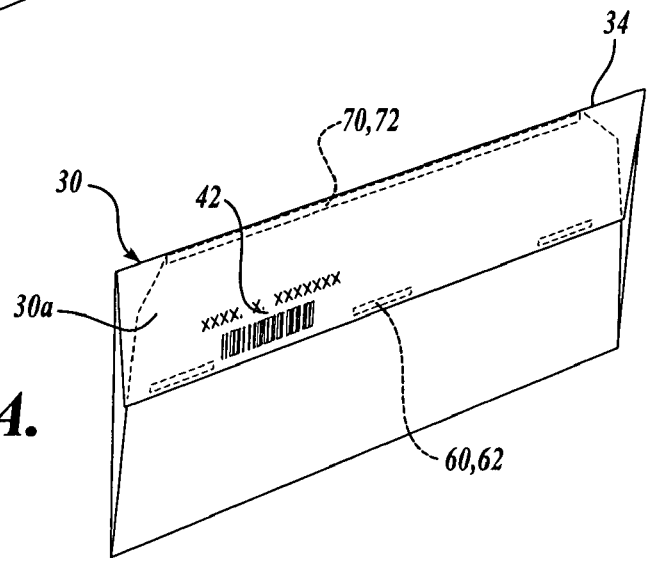
Figure 8B:
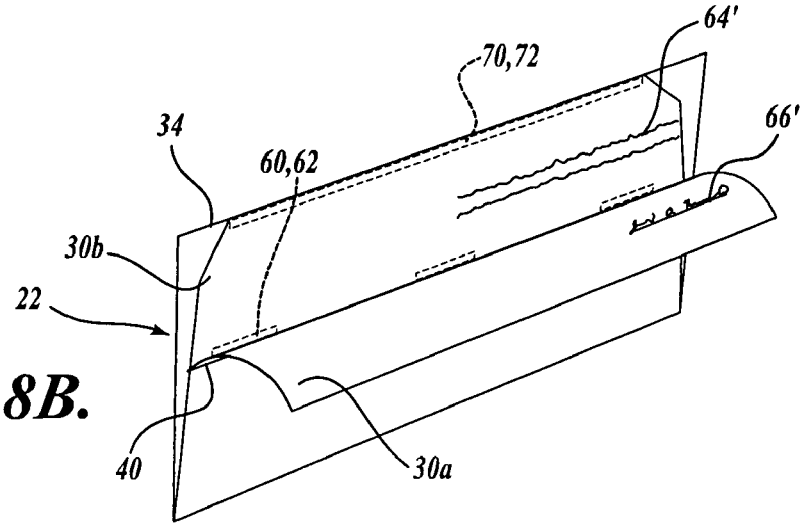

As shown in FIG. 8A, the human readable and bar code readable information 42 for the voter are still clearly visible on the intermediate portion 30*a* of the flap 30 while the original mailing address is obscured. The voter instructions/affidavit 64' and signature line 66', however, are also hidden between the bi-folded flap portions 30*a* and 30*b*. As shown in FIG. 8B, the voter information 64' and signature 66' can be made visible merely by slitting the envelope 22 along the original flap fold line 34. This will free what was the inside end of the intermediate portion 30*a* and will allow it to be folded downwardly along the zone of weakness 40 to expose the affidavit information 64' and signature line 66'.

Figure 9:
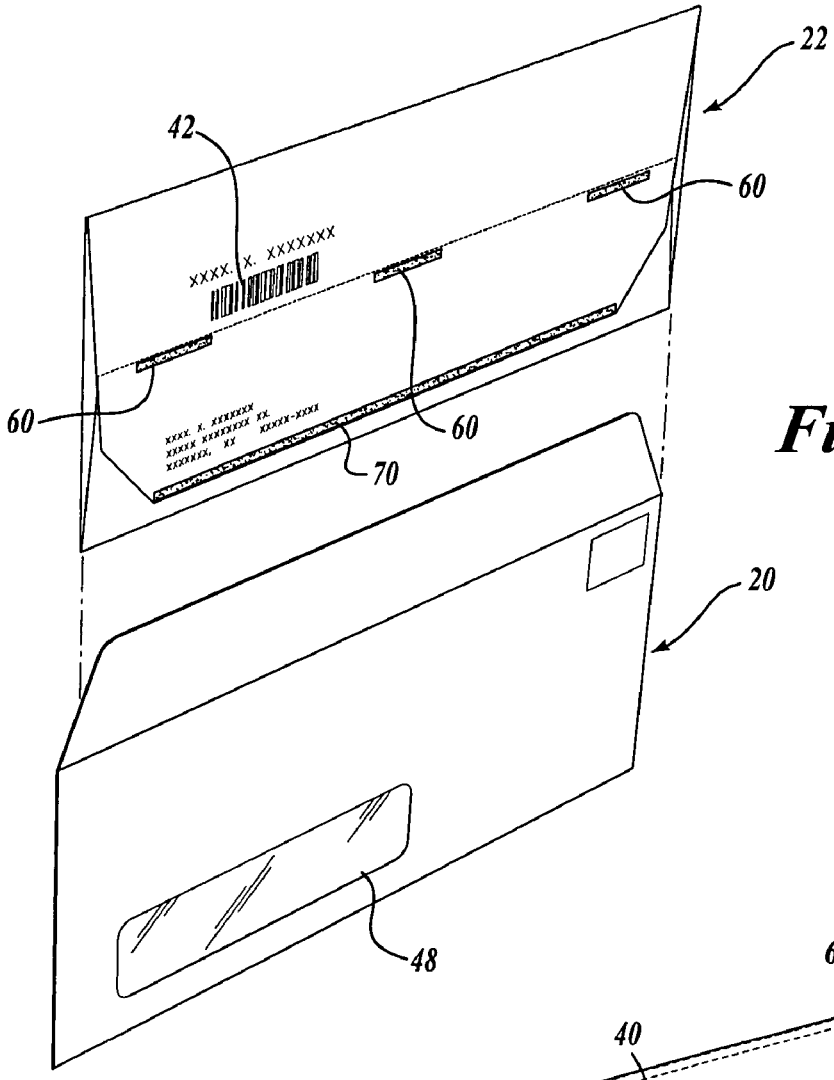
FIGS. 9, 10, 11, and 12 are isometric views of a third embodiment of the present invention.
Figure 10:
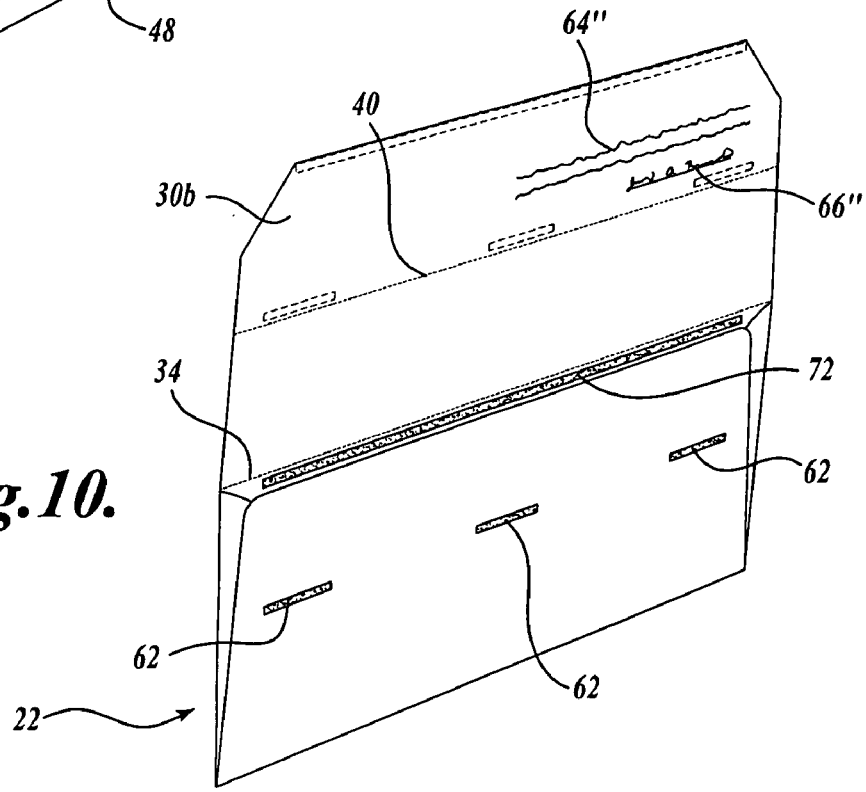
Figure 11:
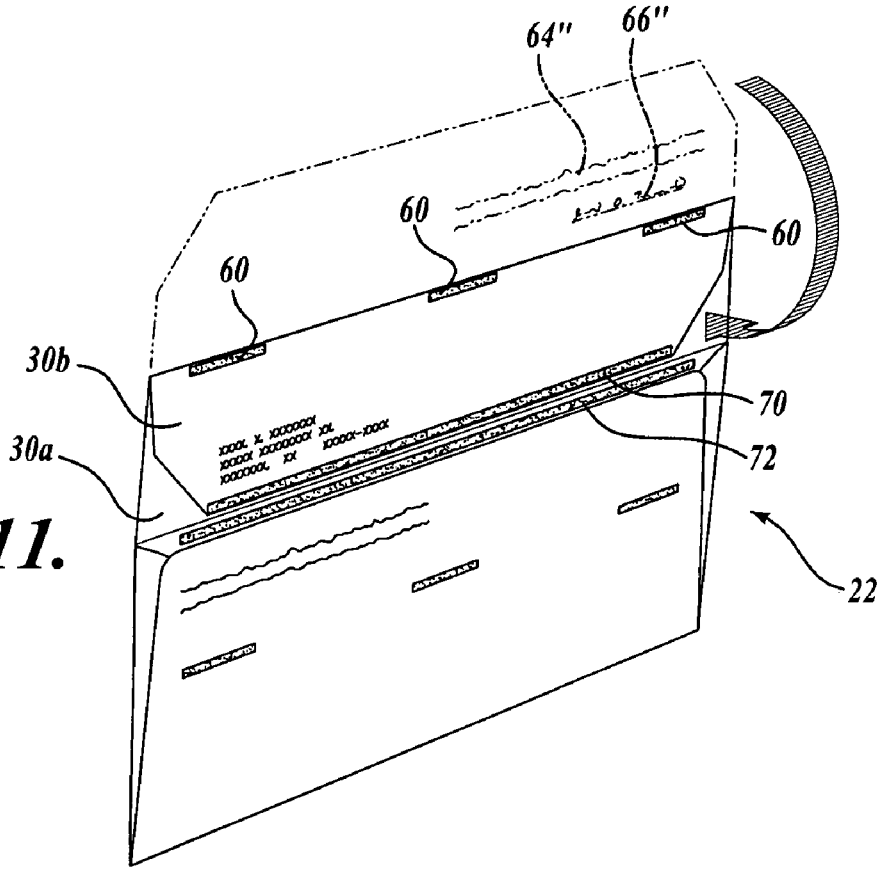
Figure 12:
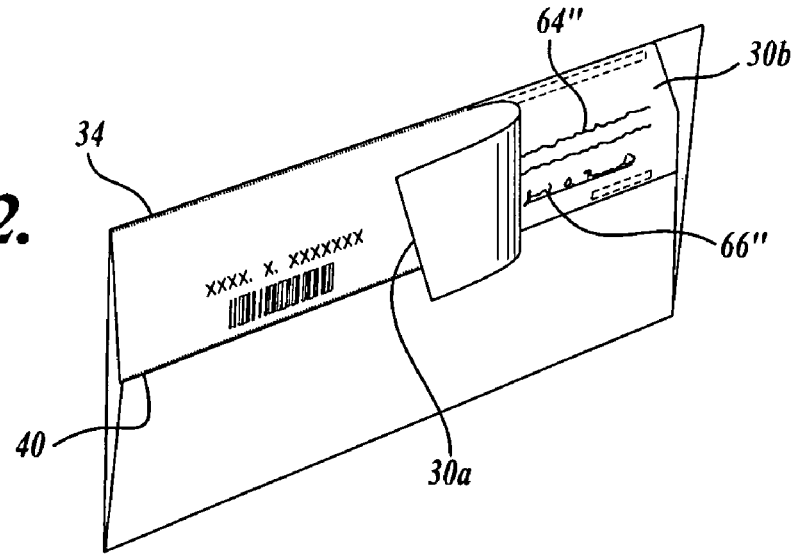
Figure 13:
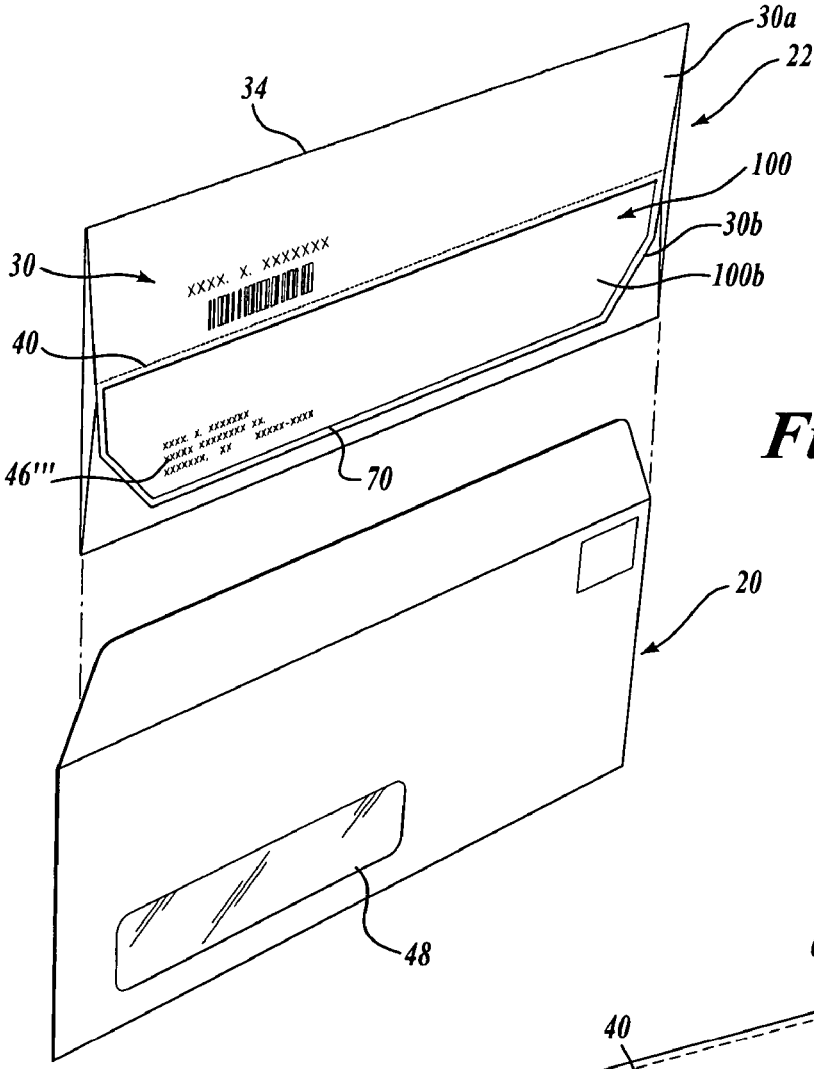
FIGS. 13, 14, 15A, 15B, 16A, and 16B are isometric views of a fourth embodiment showing a modification that can be employed with both the second and third embodiments of the present invention.

Referring now to FIGS. 9-12, an alternative to the just-described embodiment is illustrated. This embodiment is constructed and printed in a manner similar to the embodiment shown in FIGS. 5-8 with the exception that the voter information/affidavit 64" and signature line 66" are both printed on the inside of the outer portion 30*b* of the flap 30. Bands of adhesive 70 and 72 are provided in the same locations as in the embodiments shown in FIGS. 5-8. In this embodiment, however, the zone of weakness 40 comprises a perforation. In addition, the upper fold line 34 is perforated as well. When the voter completes the signature, inserts the ballot, and folds the envelope flap, he/she does so as described in conjunction with FIGS. 6-8 and as shown in FIGS. 9, 10, and 11. This provides for a folded return configuration similar to that shown in FIG. 8A. However, as shown in FIG. 12, because fold lines 34 and 40 are both perforated, a side of the intermediate portion 30*a* of the flap 30 can be grasped and peeled horizontally across the envelope allowing the perforations 34 and 40 to separate. After the intermediate portion 30*a* is removed, the voter information/affidavit 64" and signature 66" appearing on the backside of the outer portion 30*b* of the flap 30 will be visible.

The embodiments of FIGS. 5-8 and 9-12 both use the strips of contact adhesive 60, 70, 62, and 72. Referring to FIGS. 13-16, and first to FIG. 13, these bands of contact adhesive can be replaced by a single large band of double-sided adhesive strip 100 that is preferably applied to the entire surface area of the outside of outer flap portion 30*b*. The double-sided adhesive strip has a backside that adheres directly on contact to the rear surface of outer flap portion 30*b*. The exterior surface of the double-sided adhesive strip has a peel-off protective strip 100*b* that prevents the outside of the adhesive strip 100 from adhering to anything until the protective strip 100*b* is removed. The outside surface of the protective strip is printable so that the original address 46'" can be printed directly on the protective strip 100*b*. The envelope is otherwise constructed in the same manner as the prior two embodiments.

Figure 14:
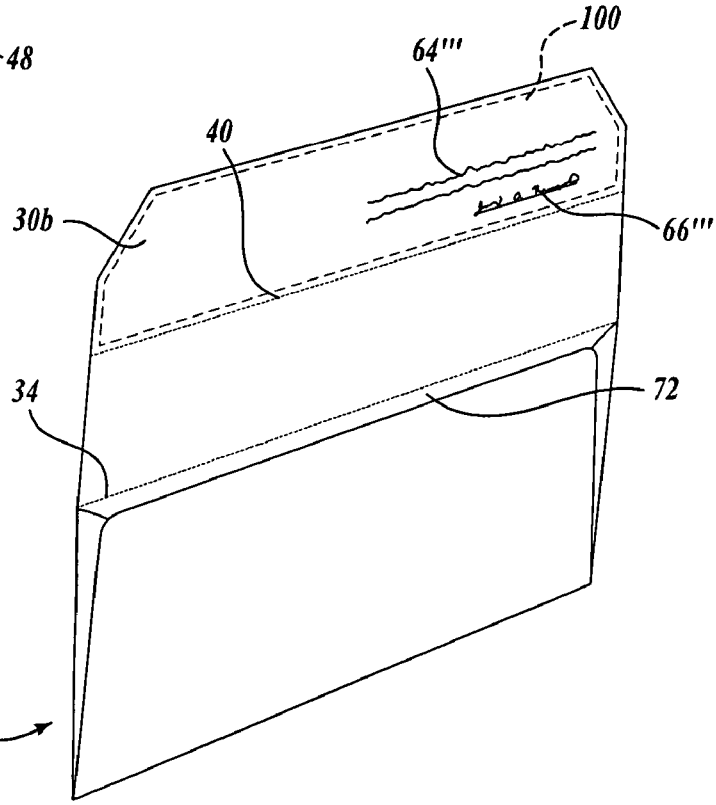
Figure 15A:
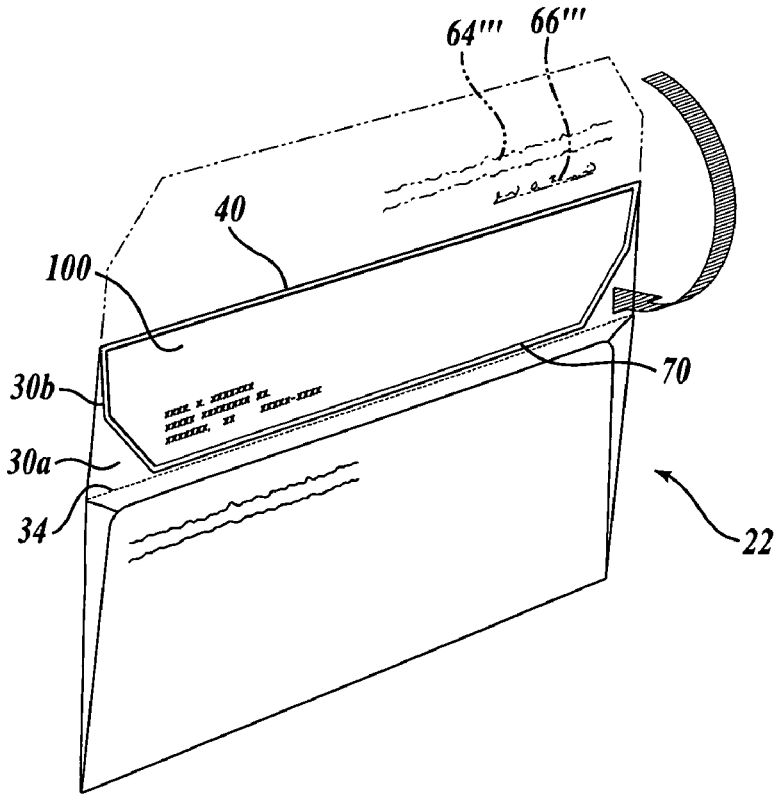
Figure 15B:
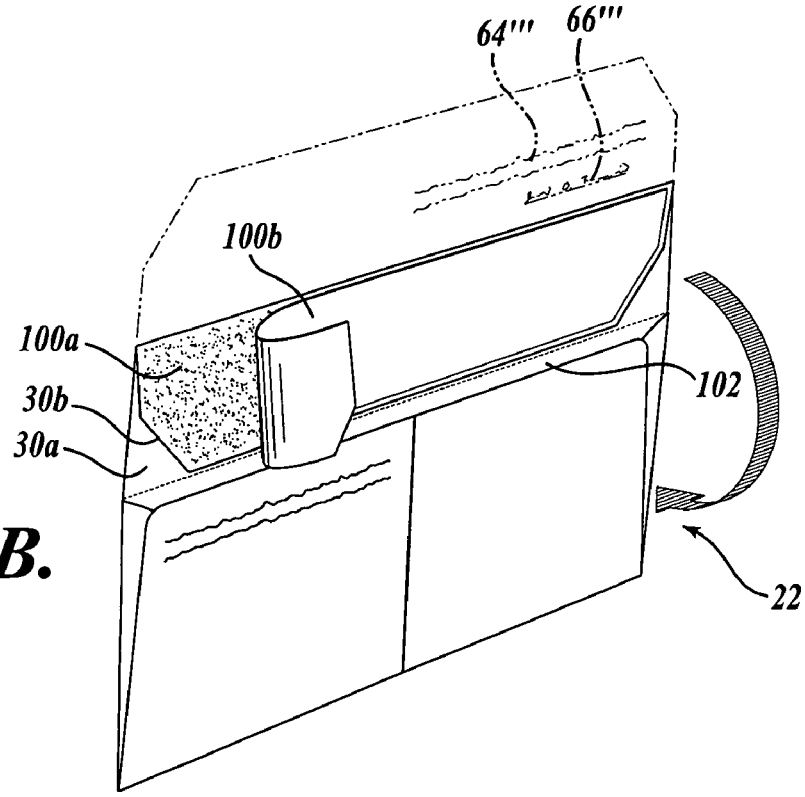
Figure 16A:
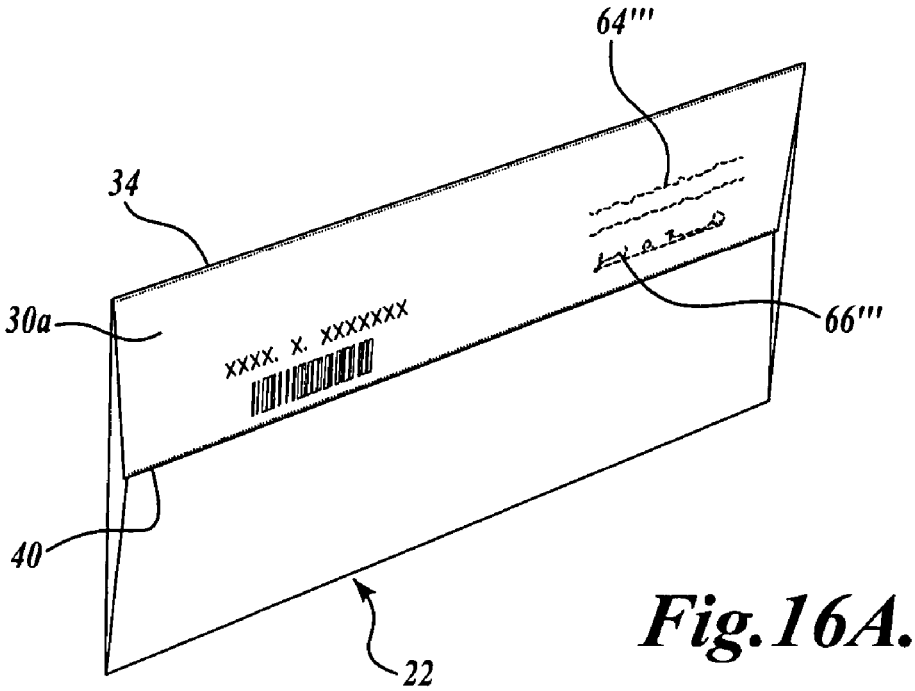

As shown in FIG. 14, in use the voter's affidavit 64' and signature 66' can be placed on the inside of outer flap portion 30*b*. As shown in FIG. 15A, the outer flap portion 30*b* is then folded inwardly toward the back surface of intermediate portion 30*a*. The peel-off strip 100*b* is then removed to expose the outside surface 100*a* of the double-sided adhesive strip as shown in FIG. 15B. Flap portions 30*a* and 30*b* are then folded over simultaneously as shown in FIG. 16A, at which point the adhesive strip 100 adheres to the region 102 of the envelope that was occupied by adhesive zones 72 in the prior embodiment and to the backside of the envelope 22 to seal the ballot or other contents inside the envelope.

Figure 16B:
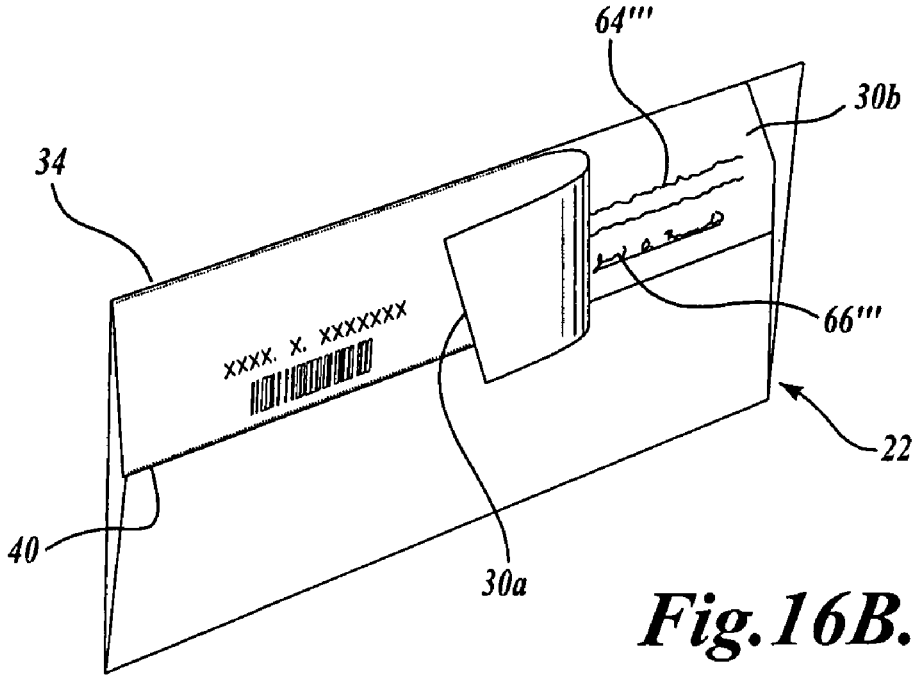

In this embodiment, the zones of weakness 34 and 40 shown in FIGS. 6A and 6B are perforated as in the embodiment described in conjunction with FIGS. 9-12. As a consequence, the intermediate flap portion 30*a* can then be peeled from the envelope 22 without revealing the envelope's contents, but revealing the voter affidavit 64'" and the voter signature 66'" as shown in FIG. 16B. If the affidavit is satisfactory, the envelope can then be unsealed and the ballot removed. If, on the other hand, the affidavit is for some reason invalid, the envelope is never opened, ensuring that the ballot is not miscounted.

The double-sided adhesive strip can be employed in conjunction with the second embodiment shown in FIGS. 5-8 in a manner virtually identical to that just described in the current embodiment.

While the preferred embodiment of the invention has been illustrated and described, it will be appreciated that various changes can be made therein without departing from the spirit and scope of the invention.

The embodiment of the invention in which an exclusive property or privilege is claimed are defined as follows:

1. A return mailing envelope comprising:

a front flap and a rear flap joined to form a pocket at the upper end thereof; and a third flap joined to the upper edge of said front flap along a first zone of weakness, said third flap being foldable along said first zone of weakness in a rearward and downward direction to a first position located behind said rear flap, said third flap in said first position having an intermediate portion joined to said front flap along said first zone of weakness and an outer portion joined to said intermediate portion along a second zone of weakness, said outer portion having a first address information thereon and visible when said third flap is in said first position, said intermediate portion having identifying indicia thereon corresponding to said first address when said third flap is in said first position, said third flap further being foldable upwardly to a second position above said front flap, said outer portion being foldable rearwardly and downwardly when said third flap is in said second position to a third position behind said intermediate portion, and said intermediate and outer portions being foldable downwardly and rearwardly from said third position to a fourth position behind said second flap to close said pocket, at least one of said outer portion and said rear flap having adhesive thereon for adhering said outer portion only to said rear flap to seal said envelope.

2. The envelope of claim 1, wherein said at least one of said zones of weakness is a score line.

3. The envelope of claim 1, wherein at least one of said zones of weakness is a perforation.

4. The envelope of claim 1, wherein the first zone of weakness is substantially parallel to the upper edge of the front flap.

5. The envelope of claim 1, wherein the second zone of weakness is substantially parallel to the first zone of weakness.

6. The envelope of claim 1, wherein said adhesive on one of said rear flap and said outer portion is a layer of wettable adhesive or a layer of contact adhesive that adheres to an opposing layer of like contact adhesive.

7. The envelope of claim 1, wherein an affidavit, signature, or voter information is printed on the inside of at least one of the intermediate and outer portions of said third flap.

8. A return mailing envelope comprising:

a front flap and a rear flap joined to form a pocket at the upper end thereof; and a third flap joined to the upper edge of said front flap along a first zone of weakness, said third flap being foldable along said first zone of weakness in a rearward and downward direction to a first position located behind said rear flap, said third flap in said first position having an intermediate portion joined to said front flap along said first zone of weakness and an outer portion joined to said intermediate portion along a second zone of weakness, said outer portion having a first address information thereon and visible when said third flap is in said first position, said intermediate portion having identifying indicia thereon corresponding to said first address when said third flap is in said first position, said third flap further being foldable upwardly to a second position above said front flap, said outer portion being foldable rearwardly and downwardly when said third flap is in said second position to a third position behind said intermediate portion, and said intermediate and outer portions being foldable downwardly and rearwardly from said third position to a fourth position behind said second flap to close said pocket, at least one of said outer portion and said rear flap having adhesive thereon for adhering said outer portion to said rear flap to seal said envelope, wherein the upper edge of said rear flap is positioned below the upper edge of said front flap to expose a portion of the inside of said front flap adjacent said first zone of weakness, said envelope further comprising adhesive applied to at least one of the upper inside portions of said front flap and outer region of said outer portion when said third flap is in said first position, so that when said intermediate and outer portions are folded to said fourth position, the outer region of said outer portion is sealed to the exposed portion of said front flap.

9. The envelope of claim 8, wherein said adhesive on one of said rear flap and said outer portion is a layer of wettable adhesive or a layer of contact adhesive that adheres to an opposing layer of like contact adhesive.

10. The envelope of claim 8, wherein said adhesive comprises a layer of adhesive adhered to the outer side of said outer portion when said third flap is in said first position, said layer having a removable protective strip thereon, said layer being positioned so as to adhere to the exposed portion of said front flap and the rear of said second flap when the strip is removed and when said outer portion is folded to said fourth position.

11. The envelope of claim 10, wherein the first address information is printed on said protective strip.

12. The envelope of claim 8 or 10, wherein an affidavit, signature, or voter information is printed on the inside of at least one of the intermediate and outer portions of said third flap.

* * * * *